US010494129B2

(12) United States Patent
Suzuki et al.

(10) Patent No.: US 10,494,129 B2
(45) Date of Patent: Dec. 3, 2019

(54) PACKAGING MACHINE FOR A PACKAGE, AND PACKAGING METHOD THEREFOR

(71) Applicant: JAPAN TOBACCO INC., Tokyo (JP)

(72) Inventors: Shinya Suzuki, Tokyo (JP); Daisuke Sumi, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 398 days.

(21) Appl. No.: 15/593,902

(22) Filed: May 12, 2017

(65) Prior Publication Data

US 2017/0247134 A1 Aug. 31, 2017

Related U.S. Application Data

(63) Continuation of application No. PCT/JP2014/080119, filed on Nov. 13, 2014.

(51) Int. Cl.
*H01F 13/00* (2006.01)
*B65B 61/00* (2006.01)
(Continued)

(52) U.S. Cl.
CPC ..... *B65B 61/00* (2013.01); *A24F 15/00* (2013.01); *B31B 50/81* (2017.08); *B31B 50/814* (2017.08); *B65B 19/20* (2013.01); *B65D 85/1045* (2013.01); *B65D 85/1081* (2013.01); *H01F 7/0273* (2013.01); *H01F 13/00* (2013.01);
(Continued)

(58) Field of Classification Search
CPC ..... H01F 13/00–13/003; B31B 50/814; B65D 2313/04
See application file for complete search history.

(56) References Cited

U.S. PATENT DOCUMENTS

2006/0010838 A1 1/2006 Ghini et al.
2008/0224806 A1 9/2008 Ogden et al.
(Continued)

FOREIGN PATENT DOCUMENTS

EP 2 468 639 A1 6/2012
JP 62-112306 A 5/1987
(Continued)

OTHER PUBLICATIONS

Japanese Office Action dated Feb. 13, 2018 for corresponding Japanese Application No. 2016-558509, with English translation.
(Continued)

*Primary Examiner* — Ramon M Barrera
(74) *Attorney, Agent, or Firm* — Birch, Stewart, Kolasch & Birch, LLP

(57) ABSTRACT

A packaging machine includes: a conveying machine that conveys a package blank for a package; a lid-side magnetizing roller that is supported so as to be able to come into contact with the lid-side magnetic region of the package blank, and so as to be rotatable when coming into contact, and has a permanent magnet which magnetizes a magnetic material of the lid-side magnetic region; and a body-side magnetizing roller that is supported so as to be able to come into contact with the body-side magnetic region of the package blank, and so as to be rotatable when coming into contact, and has a permanent magnet for magnetizing a magnetic material of the body-side magnetic region so as to form a predetermined magnetic distribution corresponding to a magnetic distribution in the lid-side magnetic region formed by the lid-side magnetizing roller.

14 Claims, 11 Drawing Sheets

(51) Int. Cl.

| | |
|---|---|
| ***B31B 50/81*** | (2017.01) |
| ***B65B 19/20*** | (2006.01) |
| ***A24F 15/00*** | (2006.01) |
| ***B65D 85/10*** | (2006.01) |
| ***H01F 7/02*** | (2006.01) |
| *B31B 110/30* | (2017.01) |
| *B31B 100/00* | (2017.01) |
| *B31B 120/10* | (2017.01) |

(52) U.S. Cl.
CPC .... *H01F 13/003* (2013.01); *B31B 2100/0028* (2017.08); *B31B 2110/30* (2017.08); *B31B 2120/102* (2017.08); *B31B 2241/003* (2013.01); *B65D 2313/04* (2013.01)

(56) References Cited

U.S. PATENT DOCUMENTS

| | | | |
|---|---|---|---|
| 2013/0327820 | A1 | 12/2013 | Clark et al. |
| 2014/0008258 | A1 | 1/2014 | Clark et al. |
| 2014/0008425 | A1 | 1/2014 | Clark et al. |
| 2015/0076154 | A1 | 3/2015 | Clark et al. |
| 2015/0089902 | A1 | 4/2015 | Clark et al. |
| 2015/0305402 | A1 | 10/2015 | Bourgoin |

FOREIGN PATENT DOCUMENTS

| | | | |
|---|---|---|---|
| JP | 5-270528 | A | 10/1993 |
| JP | 2000-043166 | A | 2/2000 |
| JP | 2001-230118 | A | 8/2001 |
| JP | 4777707 | B2 | 9/2011 |
| WO | WO 2012/058413 | A2 | 5/2012 |
| WO | WO 2013/176937 | A1 | 11/2013 |
| WO | WO 2014/096427 | A1 | 6/2014 |

OTHER PUBLICATIONS

International Search Report (PCT/ISA/210) issued in PCT/JP2014/080119, dated Feb. 17, 2015.
Extended European Search Report for Application No. 14905917.2, dated Jun. 28, 2018.
Written Opinion of the International Searching Authority (PCT/ISA/237) issued in PCT/JP2014/080119, dated Feb. 17, 2015.

PACKAGING MACHINE FOR A PACKAGE, AND PACKAGING METHOD THEREFOR

CROSS-REFERENCE TO RELATED APPLICATIONS

This application is a continuation application of International Application PCT/JP2014/080119 filed on Nov. 13, 2014 and designated the U.S., the entire contents of which are incorporated herein by reference.

TECHNICAL FIELD

The present invention relates to a packaging machine for a package having a package body, and a lid part for a housing space of the package body, and a packaging method therefor.

BACKGROUND ART

Recently, as a package for a cigarette, a large number of lid packages are adopted. In the lid package, a lid part is hinged to a body side of the lid package, so that a filter cigarette in the inside on the body side can be satisfactorily protected from the outside. Additionally, with the lid part closed, dust in the package is inhibited from falling outside. Therefore, the lid package preferably includes a locking mechanism for the lid part in order to prevent the lid part from opening accidentally. For example, the locking mechanism is implemented by utilizing engagement of a tongue piece foamed by being cut and raising from an inner frame of the package, and an edge formed in an inner flap of the lid part. In this case, the lid part needs to be opened by force for disengaging the tongue piece from the edge in order to open the lid part, and therefore accidental opening of the lid part is prevented.

Herein, a packaging machine that manufactures a lid package having such a locking mechanism which controls opening and closing a lid part is disclosed in, for example, Patent document 1. In the packaging machine, in order to manufacture a tongue piece which is a part of the locking mechanism, a function of forming a tongue piece forming part is added to a notch which forms a blank from a web, while a folding protrusion and a folding hole for folding the tongue piece forming part are provided in a folding tacker and a tacker receiver used for folding of the blank.

In a lid package disclosed in Patent document 2, magnet members are utilized for a locking mechanism for a lid part and a body side. More specifically, the lid part is locked to the body side by magnetic attraction of a magnetic material on an inner flap, and a magnetic material on a lid part side, to such an extent that accidental opening of the lid part is prevented. Patent document 2 mentions that these magnet members are magnetized during manufacturing of the package.

[Patent document 1] Japanese Patent Laid-Open No. 2000-43166

[Patent document 2] International Publication No. 2014/096427

[Patent document 3] Japanese Patent Laid-Open No. 5-270528

[Patent document 4] Japanese Patent No. 4777707

SUMMARY OF INVENTION

Technical Problem

In the prior arts, in a case where attraction of the magnetic materials is utilized as the locking mechanism of the lid part of the lid package, how the magnetic materials are magnetized at which timing is not specifically studied. The magnetization of the magnetic materials needs to be performed such that suitable locking between the lid part and the package body is formed, namely, suitable relative positional relation is formed so as to bring the lid part into contact with the package body without deviating the relative position of the lid part and the package body. However, in the prior arts, a magnetization aspect of the magnetic materials is not specifically disclosed.

Particularly, in a case where a large number of lid packages are manufactured by a packaging machine, time necessary for magnetizing magnetic materials needs to be reduced as short as possible in order to enhance manufacturing efficiency. However, when the time necessary for the magnetization is reduced, it becomes difficult to form desired magnetic distributions in the magnetic materials, and it becomes difficult to obtain a locking state of the suitable relative positional relation between the lid part and the package body.

The present invention has been made in view of the above problems, and an object of the present invention is to provide a packaging machine that forms desired magnetic distributions in magnetic materials as quickly as possible in a manufacturing step of a lid package having a locking mechanism between a lid part and a package body by utilizing the magnetic materials in the packaging machine.

Solution to Problem

In order to solve the above problems, a packaging machine of the present invention adopts a configuration in which respective magnetic regions each coated with a magnetic material containing a magnetic material are formed on a lid part and a package body side, and magnetizing rollers that magnetize the magnetic materials while coming into contact therewith are utilized. The magnetizing rollers magnetize the magnetic materials by coming into contact with the magnetic regions, and therefore each magnetic region can be magnetized while the package blank is conveyed, and it is possible to quickly and stably form a magnetic distribution in each magnetic region.

More specifically, the present invention is a packaging machine for a package, the package having a package body having a housing space for housing an object to be housed, and a lid part formed so as to cover an opening of the housing space of the package body, wherein the lid part is provided with a lid-side magnetic region that is coated with an unmagnetized magnetic material, and the package body is provided with a body-side magnetic region that is coated with an unmagnetized magnetic material, at such a predetermined position on the package body as to face the lid-side magnetic region in a complete state of the package where the lid part covers the opening of the housing space. Additionally, the packaging machine includes: a conveying machine that conveys a package blank for the package, while in the package blank, at least a first blank portion related to the lid-side magnetic region, and a second blank portion related to the body-side magnetic region are in a predetermined unfolded state; a lid-side magnetizing roller that is supported so as to be able to come into contact with the lid-side magnetic region of the package blank being conveyed in the predetermined unfolded state by the conveying machine, and so as to be rotatable when coming into contact, and has a permanent magnet which magnetizes the magnetic material of the lid-side magnetic region; and a body-side magnetizing roller that is supported so as to be able to come into contact with the body-side magnetic region of the package blank being conveyed in the predetermined unfolded state by the conveying machine, and so as to be rotatable when coming into contact, and has a permanent magnet for magnetizing the magnetic material of the body-side magnetic region so as to form a predetermined magnetic distribution corresponding to a magnetic distribution in the lid-side magnetic region formed by the lid-side magnetizing roller.

In the packaging machine according to the present invention, the package having the package body and the lid part is manufactured from the package blank. Herein, the package blank includes the lid-side magnetic region that is a magnetic region on the lid part side, and the body-side magnetic region that is a magnetic region on the package body. Placement on the package blank is determined such that both the magnetic regions face each other in a completed state as a package after magnetization. Herein, as both the magnetic materials included in the magnetic regions, for example, a coating material containing a ferrite-based magnetic material or a neodymium-based magnetic material can be adopted. Both the magnetic regions only need to be not yet magnetized (unmagnetized state) at a point of time before magnetization processing described below. As to magnetic region forming time, the magnetic regions may be already coated on the package blank before the package is manufactured by the packaging machine, or the magnetic regions may be coated in a stage before the magnetization processing which is a process of package manufacturing by the packaging machine.

The magnetization of the lid-side magnetic region and the body-side magnetic region formed on the package blank is implemented by actions of the lid-side magnetizing roller and the body-side magnetizing roller corresponding to the respective magnetic regions on conveyance of the package blank in the predetermined unfolded state by the conveying machine. More specifically, the conveying machine conveys the package blank in the predetermined unfolded state. This predetermined unfolded state is such a state where the first blank portion related to the lid-side magnetic region, and the second blank portion related to the body-side magnetic region are unfolded such that the lid-side magnetizing roller and the body-side magnetizing roller can come into contact with the respective magnetic regions. Accordingly, a blank portion other than the first blank portion and the second blank portion in the package blank may be folded to some extent in order to manufacture the package as long as each magnetic region can be magnetized, or may be unfolded like the first blank portion and the like.

As the conveyance form by the conveying machine, various forms can be adopted, as long as magnetization of the respective magnetic regions by the lid-side magnetizing roller and the body-side magnetizing roller, described below, is possible. For example, a conveying machine that conveys the package blank on a straight line may be adopted, or a drum-type conveying machine that conveys the package blank along a predetermined circumference may be adopted.

Both the rollers are disposed with respect to the package blank being conveyed in the predetermined unfolded state by the conveying machine such that the lid-side magnetizing roller comes into contact with the lid-side magnetic region on the first blank portion, and the body-side magnetizing roller comes into contact with the body-side magnetic region on the second blank portion. The permanent magnets are rotatably supported on the support shafts. Therefore, when the respective magnetizing rollers come into contact with the corresponding magnetic regions on the package blank being conveyed, the permanent magnets rotate, so that the package blank is conveyed downstream while the contact states between the permanent magnets and the respective magnetic regions are maintained. Therefore, the respective magnetic regions are magnetized without preventing conveyance of the package blank, and the contact states between the magnetic regions and the respective magnetizing rollers are maintained. Accordingly, it is possible to stably form a desired magnetic distribution in each magnetic region.

In each of the magnetized lid-side magnetic region and the magnetize body-side magnetic region, a predetermined magnetic distribution in which the magnetic distribution in the body-side magnetic region corresponds to the magnetic distribution in the lid-side magnetic region is formed such that both the magnetic regions are locked to each other by magnetic attraction. That is, the magnetic distributions in the both the magnetic regions are formed such that suitable locking by magnetic attraction between magnetic N poles and S poles is possible. For example, the S pole is formed in a portion of the lid-side magnetic region which faces a portion, where the N pole is formed in the body-side magnetic region, in the completed state of the package. From a broad view, the N pole portions and the S pole portions in the respective magnetic regions are disposed corresponding to each other such that the locking state of the lid part and the package body becomes a suitable locking state with no deviation.

Herein, in the above packaging machine, contact with the lid-side magnetic region by the lid-side magnetizing roller, and contact with the body-side magnetic region by the body-side magnetizing roller may be performed in at least a partially overlapped period. Additionally, as another method, contact with the lid-side magnetic region by the lid-side magnetizing roller, and contact with the body-side magnetic region by the body-side magnetizing roller may be performed in different periods which are not overlapped. In either contact form, the lid-side magnetizing roller and the body-side magnetizing roller perform magnetization processing by coming into contact with the lid-side magnetic region and the body-side magnetic region, respectively, and therefore it is possible to stably form the magnetic distribution in each magnetic region.

Herein, in the above packaging machine, the lid-side magnetizing roller may be formed by alternately supporting a plurality of lid-side magnet disks each formed of the permanent magnet, and a plurality of lid-side magnetic substance disks each formed of a magnetic substance on a support shaft rotatably, the body-side magnetizing roller may be famed by alternately supporting a plurality of body-side magnet disks each having the same width as each of the lid-side magnet plates and each formed of the permanent magnet, and a plurality of body-side magnetic substance disks each having the same width as each of the lid-side magnetic substance disks and each formed of a magnetic substance on a support shaft rotatably. In this case, a belt-shaped magnetic distribution is formed in the lid-side magnetic region by the lid-side magnetizing roller, and the predetermined magnetic distribution may be formed in a belt shape in the body-side magnetic region by the body-side magnetizing roller.

Thus, the lid-side magnetizing roller and the body-side magnetizing roller are each formed by alternately disposing the magnet disks and the magnetic substance disks, so that the respective corresponding belt-shaped magnetic distributions can be formed in the lid-side magnetic region and the body-side magnetic region. That is, the width of the belt-shaped magnetic distribution in each magnetic region is formed by contact of side surfaces of the corresponding magnet disk and magnetic substance disk and each magnetic region. Thus, the belt-shaped magnetic region is formed, such that it is possible to improve magnetic attraction that acts between the lid-side magnetic region and the body-side magnetic region.

Furthermore, a diameter of each of the lid-side magnetic substance disks may be not less than a diameter of each of the lid-side magnet disks, and a diameter of each of the body-side magnetic substance disks may be not less than a diameter of each of the body-side magnet disks. Thanks to diligent efforts of the inventor of this application, it is found that magnetic distribution formation in the corresponding magnetic regions can be suitably performed by making the respective diameters of the lid-side and body-side magnetic substance disks to be equal to or larger than the diameters of the corresponding magnet disks. In a case where the diameter of each magnetic substance disk is made larger than the diameter of each magnet disk, the different amount of the diameters only need to be suitably determined by considering magnetic force and the like in the magnetic distributions formed in the magnetic regions.

The packaging machine described above further includes: a lid-side counter roller that is formed of a nonmagnetic substance, is located on a side opposite to the lid-side magnetizing roller with the package blank sandwiched between the lid-side counter roller and the lid-side magnetizing roller when the lid-side magnetizing roller comes into contact with the package blank, and is similarly supported so as to be able to come into contact with the package blank, and so as to be rotatable when coming into contact; and a body-side counter roller that is formed of a nonmagnetic substance, is located on a side opposite to the body-side magnetizing roller with the package blank sandwiched between the body-side counter roller and the body-side magnetizing roller when the body-side magnetizing roller comes into contact with the package blank, and is similarly supported so as to be able to come into contact with the package blank, and so as to be rotatable when coming into contact.

As described above, the lid-side counter roller is disposed so as to be paired with the lid-side magnetizing roller, and the body-side counter roller is disposed so as to be paired with the body-side magnetizing roller, so that in magnetization in each magnetic region, the corresponding magnetic region is sandwiched between each magnetizing roller and each counter roller, and a contact property between each magnetizing roller and each magnetic region can be made more satisfactory. As a result, it is possible to more suitably form the desired magnetic distributions in the lid-side magnetic region and the body-side magnetic region.

Herein, the lid-side counter roller and the body-side counter roller are each formed of a nonmagnetic substance material. As a result, only a magnetic field formed by the corresponding magnetizing roller acts in the magnetization in each magnetic region. The lid-side magnetic region and the body-side magnetic region are formed by being coated with respective magnetic materials, and therefore the thickness of each region is relatively thin. The inventor of this application finds that in a case where such a relatively thin magnetic material is magnetized, when a magnetic field that reaches the counter roller from the magnetizing roller is utilized, the magnetic material is not suitably magnetized, and on the other hand, when the counter roller is the nonmagnetic substance, and only a magnetic field formed by the magnetizing roller acts on the magnetic material, the magnetic material is effectively magnetized. Accordingly, formation of the counter roller side formed of the nonmagnetic substance material suitably contributes to solution of the problems of the present invention. As the nonmagnetic substance material that forms each of the counter rollers, a resin material can be exemplified.

Herein, in the above packaging machine that includes the lid-side counter roller and the body-side counter roller, the conveyance state of the package blank includes two conveyance forms. First, in a first conveyance aspect, the predetermined unfolded state is a state where the first blank portion and the second blank portion are located on opposite sides in a direction perpendicular to a conveying direction of the package blank with a central portion of the package blank therebetween. This conveyance aspect is referred to as lateral conveyance.

In a case where the package blank is laterally conveyed by the conveying machine, the conveying machine may have a regulating member of a predetermined height, the regulating member being a member which forms a placement space for disposing the package blank in the predetermined unfolded state and regulate movement of the package blank at front and rear in the conveying direction of the package blank, and the regulating member may be disposed so as to come into contact with the package blank from the front and the rear in the conveying direction, and a chamfer may be formed on an upper edge of the regulating member on a side close to the placement space.

In a case of the lateral conveyance, when the lid part side and the package body side that are in a sandwiching state of the package blank for magnetization processing deviate from each other, frictional force by sandwiching acts on one side of the package blank being conveyed, and therefore there is a fear that the package blank is rotated on the conveying surface by this frictional force. However, as described above, the regulating material is disposed so as to come into contact with the package blank at the front and the rear in the conveying direction, so that even if force for rotating the package blank acts, positional deviation of the package blank can be suppressed by the state of contact with the package blank of the regulating material. However, when the regulating material is disposed so as to come into contact with the package blank, it is not easy to dispose the package blank in the placement space formed by the regulating material. Therefore, the chamfer is formed on the upper edge of the regulating material on the side close to the placement space, so that the package blank can be lowered from above with respect to the placement space and easily disposed at the position by a guide effect by the chamfer.

In the case where the package blank is laterally conveyed by the conveying machine as described above, as another method, the conveying machine may have a regulating member of a predetermined height, the regulating member being a member which forms a placement space for disposing the package blank in the predetermined unfolded state and regulate movement of the package blank at front and rear in the conveying direction of the package blank, and a pressing device that presses the package blank disposed in the placement space against a conveying surface from above. The package blank is pressed in the placement space by such a pressing device, so that even if the force for rotating the package blank acts, it is possible to suppress the positional deviation of the package blank.

As a second conveyance aspect, the predetermined unfolded state is a state where the first blank portion and the second blank portion are located along a conveying direction of the package blank. This conveyance aspect is referred to a longitudinal conveyance. In a case where this longitudinal conveyance is performed, the lid-side counter roller and the body-side counter roller are disposed such that one of the lid-side counter roller and the body-side counter roller is located on an upstream side with respect to the other counter roller along a conveying direction of the package, the lid-side counter roller has, on a roller periphery, a first protrusion enabling the first blank portion to be sandwiched between the lid-side magnetizing roller and the first protrusion in a period in which the lid-side magnetizing roller is in contact with the lid-side magnetic region, and the lid-side counter roller is formed such that the lid-side magnetizing roller is in non-contact with the package blank in a case where the lid-side counter roller is in contact with the package blank at a portion on the periphery other than the first protrusion, the body-side counter roller has, on a roller periphery, a second protrusion enabling the second blank portion to be sandwiched between the body-side magnetizing roller and the second protrusion in a period in which the body-side magnetizing roller is in contact with the body-side magnetic region, and the body-side counter roller is formed such that the body-side magnetizing roller is in non-contact with the package blank in a case where the body-side counter roller is in contact with the package blank at a portion on the periphery other than the second protrusion. Additionally, the first protrusion and the second protrusion are disposed in the lid-side counter roller and the body-side counter roller respectively such that the lid-side magnetic region comes into contact with the lid-side magnetizing roller, and does not come into contact with the body-side magnetizing roller, and the first protrusion and the second protrusion are further disposed in the lid-side counter roller and the body-side counter roller respectively such that the body-side magnetic region comes into contact with the body-side magnetizing roller, and does not come into contact with the lid-side magnetizing roller.

In a case where the package blank is longitudinally conveyed by the conveying machine, the first blank portion and the second blank portion are located to be lined along the conveying direction of the package blank. Therefore, there is a possibility that the one magnetic region is magnetized in an overlapped manner by the two magnetizing rollers depending on the placement relation between the lid-side magnetizing roller and the body-side magnetizing roller. When the one magnetic region is magnetized in the overlapped manner, the magnetic distribution formed therein becomes a disordered distribution, that is, becomes a distribution which is not the desired magnetic distribution, which is unpreferable.

Therefore, as described above, the first protrusion is provided on the periphery of the lid-side counter roller, and the second protrusion is provided on the periphery of the body-side counter roller. Consequently, in a state where the first blank portion is sandwiched between the lid-side magnetizing roller and the lid-side counter roller (first protrusion) due to existence of the first protrusion, the lid-side magnetizing roller comes into contact with the lid-side magnetic region on the first part, and the sandwiching state is eliminated by rotation of the lid-side counter roller, the contact of the lid-side magnetizing roller with lid-side magnetic region is also eliminated. Similarly, in a state where the second blank portion is sandwiched between the body-side magnetizing roller and the body-side counter roller (second protrusion) due to existence of the second protrusion, the body-side magnetizing roller comes into contact with the body-side magnetic region on the second part, and the sandwiching state is eliminated by rotation of the body-side counter roller, the contact of the body-side magnetizing roller with body-side magnetic region is also eliminated. Accordingly, with such a configuration, even in a case where the longitudinal conveyance is performed, only the lid-side magnetizing roller comes into contact with the lid-side magnetic region, and only the body-side magnetizing roller comes into contact with the body-side magnetic region, so that it is possible to avoid the above state where the one magnetic region is magnetized in the overlapped manner.

Additionally, the present invention can be grasped from an aspect of a packaging method for a package. In this case, the present invention is a packaging method for a package, the package having a package body having a housing space for housing an object to be housed, and a lid part formed so as to cover an opening of the housing space of the package body, wherein the lid part is provided with a lid-side magnetic region that is coated with an unmagnetized magnetic material, the package body is provided with a body-side magnetic region that is coated with an unmagnetized magnetic material, at such a predetermined position on the package body as to face the lid-side magnetic region in a complete state of the package where the lid part covers the opening of the housing space. The packaging method includes: a conveying step of conveying a package blank for the package, while in the package blank, at least a first blank portion related to the lid-side magnetic region, and a second blank portion related to the body-side magnetic region are in a predetermined unfolded state, a lid-side magnetizing step of bringing a lid-side magnetizing roller having a permanent magnet and rotatably supported into contact with the lid-side magnetic region of the package blank being conveyed in the predetermined unfolded state, and magnetizing the magnetic material of the lid-side magnetic region; and a body-side magnetizing step of bringing a body-side magnetizing roller having a permanent magnet and rotatably supported into contact with the body-side magnetic region of the package blank being conveyed in the predetermined unfolded state, and magnetizing the magnetic material of the body-side magnetic region so as to form a predetermined magnetic distribution corresponding to a magnetic distribution in the lid-side magnetic region formed by the lid-side magnetizing roller. According to this packaging method, it is possible to stably form a magnetic distribution in each magnetic region, similarly to the case of the above packaging machine.

In the above packaging method for a package, contact with the lid-side magnetic region by the lid-side magnetizing roller in the lid-side magnetizing step, and contact with the body-side magnetic region by the body-side magnetizing roller in the body-side magnetizing step may be performed in at least a partially overlapped period. As another method, contact with the lid-side magnetic region by the lid-side magnetizing roller in the lid-side magnetizing step, and contact with the body-side magnetic region by the body-side magnetizing roller in the body-side magnetizing step may be performed in different periods which may be not overlapped.

Furthermore, in the above packaging method for a package, in the conveying step, the package blank may be conveyed such that the first blank portion and the second blank portion are located along a conveying direction of the package blank, and the magnetization of the magnetic material of the lid-side magnetic region in the lid-side magnetizing step, and the magnetization of the magnetic material of the body-side magnetic region in the body-side magnetizing step may be sequentially performed in accordance with conveyance of the package blank such that in a state where the lid-side magnetic region and the body-side magnetic region face each other at a time of formation of the package, magnetic fields formed in one portion of the lid-side magnetic region and one portion of the body-side magnetic region that face each other may be different from each other. In the present invention, which magnetization is first performed is not limited. In addition, as long as technical discrepancy is not caused, the technical ideas disclosed in the above packaging machine can be applied to the packaging method for a package of the present invention.

Advantageous Effects of Invention

According to the present invention, it is possible to provide a packaging machine that forms a desired magnetic distribution in a magnetic material as quickly as possible in a manufacturing process of a lid package having a locking mechanism between a lid part and a package body by utilizing the magnetic material in the packaging machine.

DESCRIPTION OF EMBODIMENT

Hereinafter, a specific embodiment of the present invention will be described with reference to the drawings. The size, materials, shapes, and relative placement and the like of components described in the embodiment are not intended to limit the scope of the invention thereto, unless otherwise stated.

Figure 1:
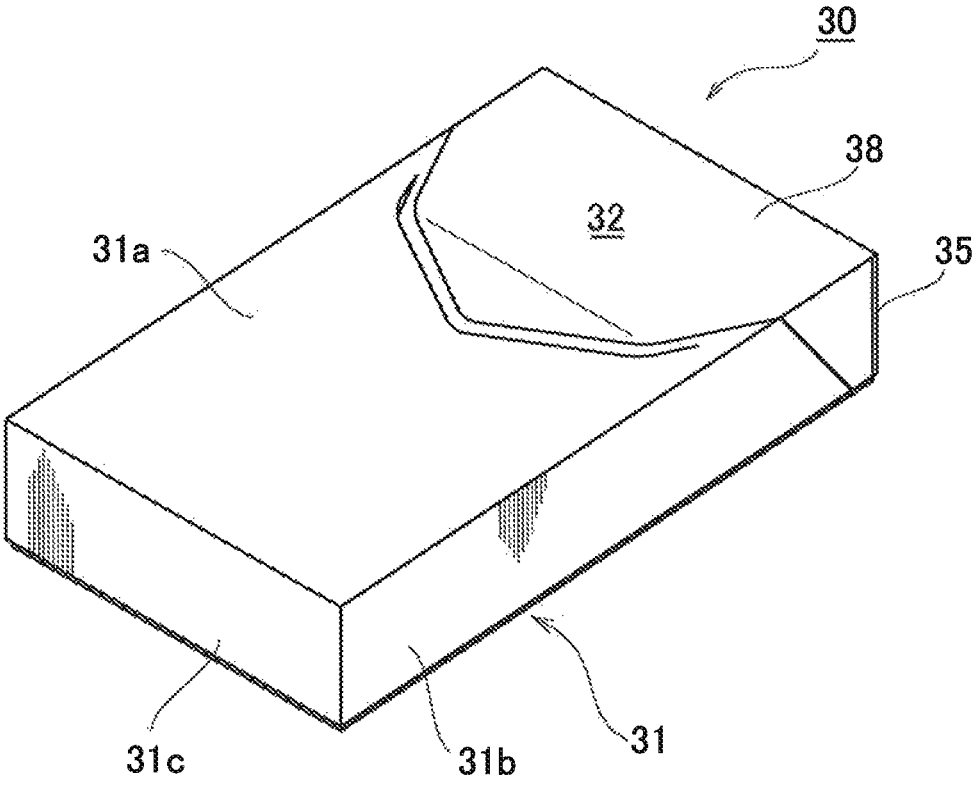
FIG. 1 is a diagram schematically illustrating a tongue-lid package manufactured by a packaging machine of the present invention.
Figure 2:
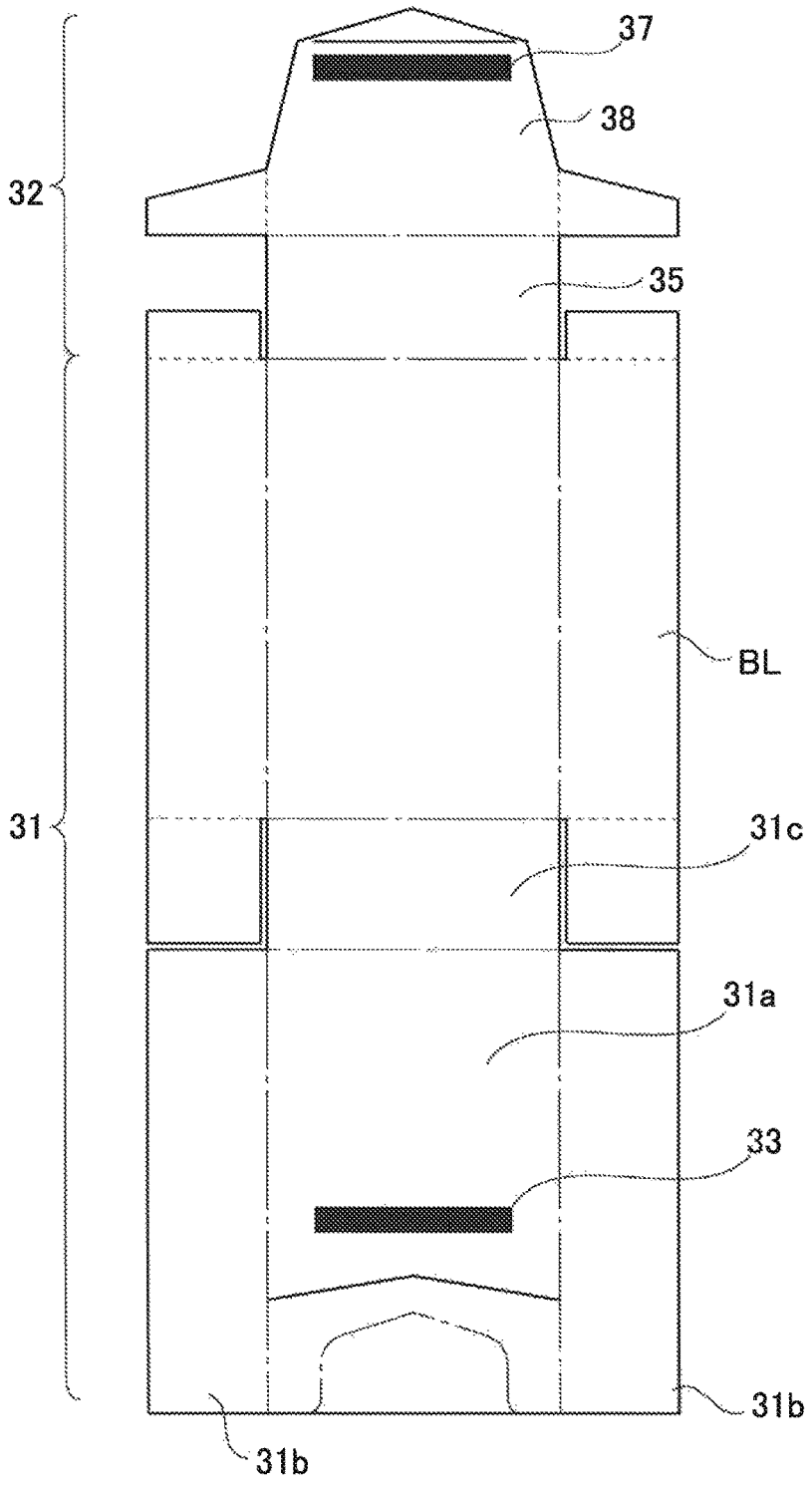
FIG. 2 is a diagram illustrating a package blank obtained by unfolding the tongue-lid package illustrated in FIG. 1.

FIG. 1 discloses a so-called tongue-lid package (hereinafter referred to simply as a "package") 30 for housing a cigarette bundle, the package 30 illustrated in FIG. 1 is in a closed state where a housing space (space where the cigarette bundle is housed) inside the package is closed. FIG. 2 illustrates a package blank BL obtained by unfolding the package 30. In the package 30, a tongue-lid part 32 is hinged to a package body 31, so that opening of the housing space inside the package body 31 can be opened and closed. In the package body 31, a front wall 31*a* located at a front surface of the package, side walls 31*b* located at side surfaces, a bottom wall 31*c* located at a bottom surface, and the like form the housing space. The tongue-lid part 32 has a lid 35 which is hinged to the package body 31, and a tongue 38 which is hinged to the lid 35. In the closed state illustrated in FIG. 1, the lid 35 is located so as to face the bottom wall 31*c* of the package body 31, and the tongue 38 is located on the front wall 31*a* of the package body 31.

The package 30 is provided with magnetic regions 33, 37 as a locking mechanism of the tongue-lid part 32 (particularly, the tongue 38) to the package body 31. The magnetic regions 33, 37 are each formed by being coated with a magnetic material containing a ferrite-based magnetic material. In the closed state of the package 30 illustrated in FIG. 1, the magnetic regions 33, 37 are magnetized, and the tongue 38 and the package body 31 are locked by magnetic attraction that acts between the both regions. For the magnetic regions 33, 37, neodymium-based magnetic materials may be utilized.

More specifically, the magnetic region 33 is formed below a cutout (not illustrated) of the front wall 31*a* included in the package body 31, as an oblong region extending to the sides of the package. On the other hand, the magnetic region 37 is formed near a leading end of the tongue 38 as an oblong region extending to the sides of the package, similarly to the magnetic region 33. The relative relation between the position of the magnetic region 33 in the package body 31, and the position of the magnetic region 37 in the tongue 38 is determined such that the above positions face each other in the above closed state.

In the package 30 thus formed, when the tongue-lid part 32 is closed from the state illustrated in FIG. 1 by a user, and the magnetic region 37 comes close to the magnetic region 33 to some extent, the tongue 38 connected by a flange is attracted toward the package body 31 by magnetic attraction that acts between both the magnetic regions, and the magnetic region 37 comes into contact with the magnetic region 33, so that contact sound which indicates the contact is generated. Then, the contact state is maintained by the magnetic attraction between both the magnetic regions.

When the tongue-lid part 32 is opened from the state where the tongue-lid part 32 closes the opening of the housing space by the contact of the both the magnetic regions, the user needs to make force larger than the magnetic attraction between both the magnetic regions to act on the tongue-lid part 32, and to rotate the tongue-lid part 32. Accordingly, as long as force smaller than the magnetic attraction acts on the tongue-lid part 32 which is in the closed state, the closed state is maintained, and therefore it can be said that the magnetic attraction is resistance force for preventing the tongue-lid part 32 from opening accidentally. Accordingly, the magnetic attraction is requested to be force that is larger than necessary resistance force, and is smaller than predetermined force such that force for intentionally opening the tongue-lid part 32 by a user does not become excessive unnecessarily.

As illustrated in FIG. 2, the package blank BL is composed of a blank portion corresponding to the package body 31, and a blank portion corresponding to the tongue-lid part 32. The blank portions each are a component forming a part of the package blank BL. Furthermore, the magnetic region 37 formed on the tongue-lid part 32 side is disposed on the blank portion corresponding to the tongue 38, and the magnetic region 33 formed on the package body 31 side is disposed on the blank portion corresponding to the front wall 31*a*. The former blank portion is equivalent to a first blank portion of the present invention, and the latter blank portion is equivalent to a second blank portion of the present invention. In this specification, as to the direction of the package blank BL, the up-and-down direction of FIG. 2, namely, the direction from one of the magnetic regions to the other magnetic region is defined as the longitudinal direction, and the right-and-left direction of FIG. 2, namely, the direction perpendicular to the longitudinal direction on a surface where the package blank BL is unfolded is defined as the lateral direction.

As can be seen from FIG. 2, any specific blank portion is not disposed on the lateral sides of the blank portion corresponding to the tongue 38 in the package blank BL. On the other hand, blank portions corresponding to the side walls 31*b* of the package body 31 are disposed on the lateral sides of the blank portion corresponding to the front wall 31*a*. Formation of a folding line itself in the package blank BL for assembling the package 30 is publicly known, and therefore description thereof will be omitted.

Now, a packaging machine that manufactures the package 30 will be described with reference to FIG. 3. The packaging machine illustrated in FIG. 3 includes a hopper 2 for cigarettes, and is provided with a cigarette filling mechanism 6 that stacks twenty cigarettes from the hopper 2 in three stages in a vertically zigzag manner to fill the stacked cigarettes into each pocket 4 is provided on the lower side of the hopper 2. A cigarette bundle is transferred on a transfer line to a vertical first wheel 8 illustrated by a dashed line. The first wheel 8 receives a bundle of the twenty cigarettes from each pocket 4 while rotating, and each cigarette bundle is pressed into a bucket 12 of a vertical second wheel 10 illustrated by a dashed line from the first wheel 8, along with an aluminum foil sheet S as an inner capsule material. At this time, the aluminum foil sheet S is longitudinally folded along the periphery of the cigarette bundle.

The aluminum foil sheet S is obtained by being cut an aluminum foil web AW fed from an aluminum foil roller AR every predetermined length, and is sequentially supplied between the first wheel 8 and the second wheel 10. A similar aluminum foil roller (not illustrated) is disposed in the vicinity of the aluminum foil roller AR, and this aluminum foil roller is a standby roller. Thereafter, with the rotation of the second wheel 10, corners and side flaps of the aluminum foil sheet S that is longitudinally folded along the cigarette bundle in the bucket are sequentially folded, so that an inner wrapping body of the cigarette bundle is formed.

A horizontal third wheel 16 is adjacent to the second wheel 10 on the opposite side of the first wheel 8. The third wheel 16 sequentially receives the inner wrapping body of the cigarette bundle in the bucket from the second wheel 10, and transfers the inner wrapping body with the rotation. Furthermore, a horizontal fourth wheel 18 is similarly disposed adjacent to the third wheel 16 on the opposite side of the second wheel 10. The fourth wheel 18 is located on the lower side of the third wheel 16, and receives the inner wrapping body IB from the third wheel 16.

Then, the fourth wheel 18 receives supply of the package blank BL illustrated in FIG. 2 from a blank supply system 22, and this package blank BL is bonded to an upper surface of the inner wrapping body IB. As illustrated in FIG. 3, the blank supply system 22 has two supply lines, namely, a supply line 22*a* and a supply line 22*b* that connect a hopper 24 and the fourth wheel 18. In the supply line 22*a*, lateral conveyance in which the package blank BL is conveyed in the lateral direction is performed. On the other hand, in the supply line 22*b*, longitudinal conveyance in which the package blank BL is conveyed in the longitudinal direction is performed. The package blank BL taken out one by one from the hopper 24 is sequentially conveyed on the supply lines 22*a*, 22*b* to be transferred to the fourth wheel 18. Herein, each package blank BL is already coated with the magnetic materials, is dried, and is provided with the magnetic regions 33, 37. In a state where the package blank BL is stored in the hopper 24, each magnetic region is not yet magnetized.

Then, a vertical fifth wheel 20 is disposed directly above a supply position of the package blank BL as viewed in the periphery direction of the fourth wheel 18, and the fifth wheel 20 receives the inner wrapping body IB with the package blank BL bonded thereto in the bucket. Thereafter, with the rotation of the fifth wheel 20, the package blank BL is sequentially folded, so that the package 30 is manufactured. Thereafter, the package 30 is transferred onto a similarly horizontal seventh wheel 28 through a horizontal sixth wheel 26 adjacent to the fifth wheel 20. In the process of the transfer of the package 30 with the rotation of the seventh wheel 28, a gluing portion of the package 30 is dried, and thereafter is fed to a feed line through a vertical eighth wheel 29. The feed line sequentially supplies the package 30 to an external packaging machine (not illustrated), and the package 30 is further packaged by a film sheet by this external packaging machine.

<Magnetization Process>

Figure 3:
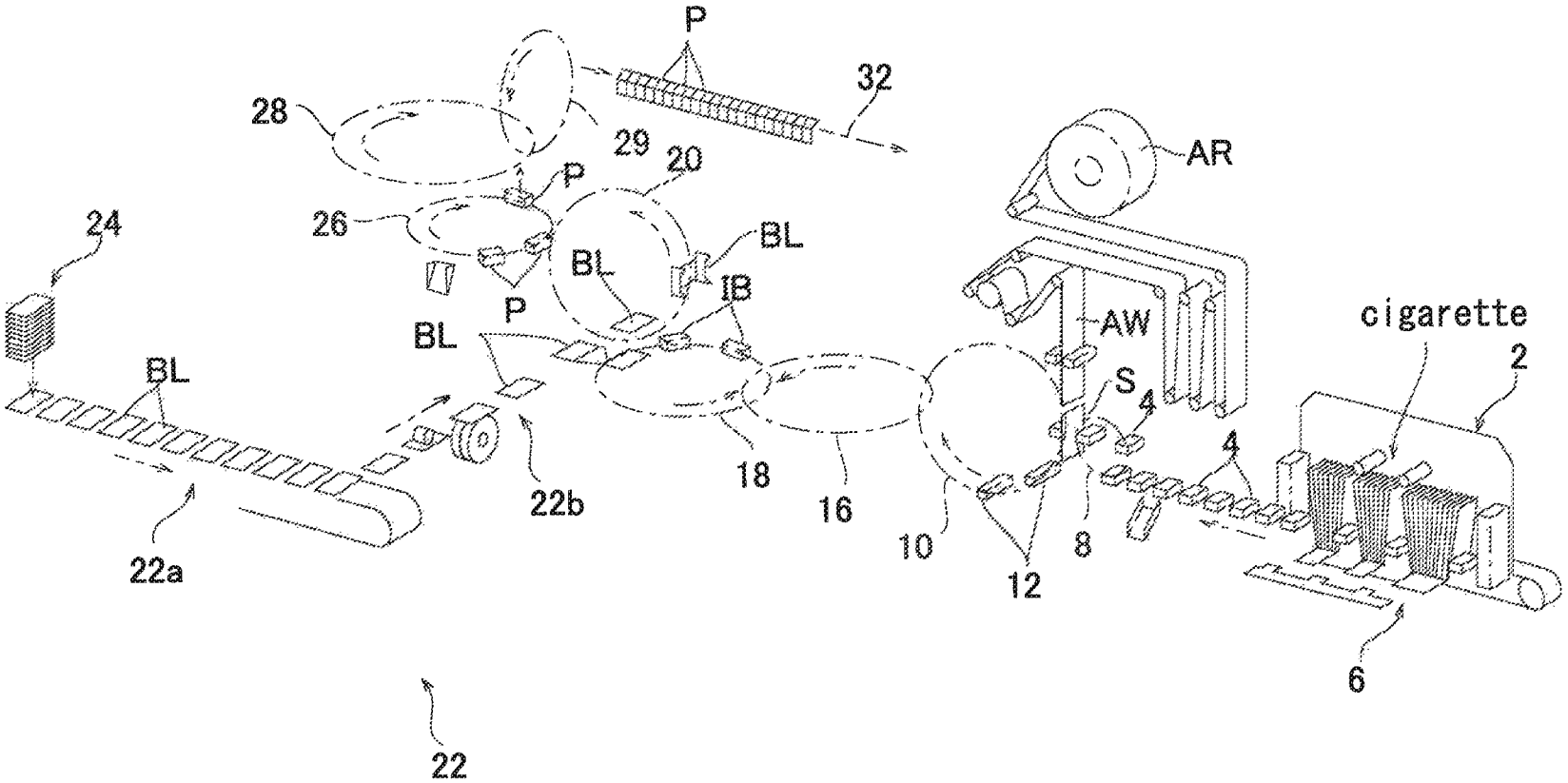
FIG. 3 is a diagram illustrating a schematic configuration of the packaging machine of the present invention.

Herein, in the packaging machine illustrated in FIG. 3, in a conveyance process of the package blank BL, magnetization processing of the magnetic regions 33, 37 formed therein is performed. At a stage where the package blank is thus stored in the hopper 24, the magnetic regions 33, 37 each are in an unmagnetized state. The reason why the magnetization processing of the magnetic regions 33, 37 is performed in the conveyance process is because when magnetized package blanks BL are stacked in the hopper 24, the package blanks BL adjacent to each other are attracted by magnetic attraction of magnetic materials, and handling of the package blanks BL becomes difficult. More specifically, in either the supply line 22*a* or the supply line 22*b* forming the blank supply system 22, the magnetization processing of the magnetic regions 33, 37 is performed.

<Magnetization Processing in Lateral Conveyance Process>

Figure 4:
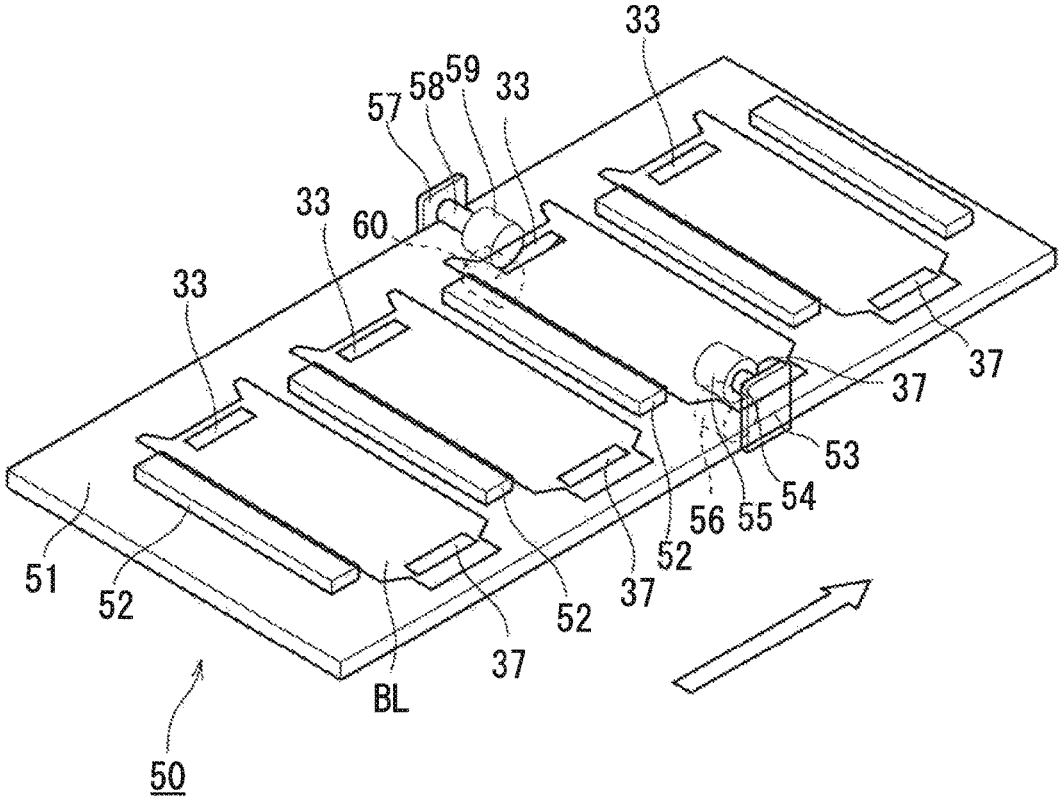
FIG. 4 is a diagram illustrating a configuration for magnetizing magnetic regions formed in the package blank, included in the packaging machine of the present invention.

First, magnetization processing in the supply line 22*a* will be described with reference to FIG. 4. FIG. 4 illustrates a configuration regarding magnetization processing in a state where the package blank BL is laterally conveyed in the supply line 22*a*. As described above, lateral conveyance of the package blank BL in the supply line 22*a* is performed in the lateral direction illustrated by a void arrow of FIG. 4 by a conveying machine 50. Therefore, in the lateral conveyance, the magnetic region 37 and the magnetic region 33 are located on respective both sides with a central portion of each package blank BL therebetween in the direction perpendicular to the conveying direction.

Herein, in the conveying machine 50, a plurality of pushers 52 are arranged on a conveyor 51 that forms a conveying surface such that a plurality of package blanks BL can be laterally conveyed. The pushers 52 each are a rectangular parallelepiped member having a predetermined height, the longitudinal direction is along the width direction of the conveyor 51. A placement space where laterally conveyed each package blank BL can be disposed in a predetermined unfolded state is formed between the adjacent pushers 52. This predetermined unfolded state means a state where the blank portion corresponding to the front wall 31*a* provided with the magnetic region 33, and the blank portion corresponding to the tongue 38 provided with the magnetic region 37 are unfolded on the conveying surface so as to be capable of being magnetized by magnetizing rollers 55, 59 described below. In this embodiment illustrated in FIG. 4, the whole of the package blank BL including both the blank portions is unfolded.

In placement of the package blank BL into a placement section 52*a* (also refer to FIGS. 6A to 6D) on the conveyor 51, each package blank BL is thrown down to the placement space 52*a* from the hopper 24. An interval between the adjacent pushers 52 is set to be slightly larger than the lateral width of the package blank BL such that the package blank BL is smoothly housed in the placement space 52*a*. The pushers 52 each function as a regulating member that regulates movement of the package blank BL so as to house the package blank BL in the placement space 52*a*.

Herein, when the package blanks BL are disposed in the placement spaces 52*a* fixed by the pushers 52, the magnetic regions 33, 37 on the package blanks BL are located at such positions as to protrude to the outside of the placement spaces 52*a* from ends of the pushers 52. As illustrated in FIG. 2, the magnetic regions 33, 37 are each oblongly formed in the lateral direction of the package blank BL, and therefore the respective longitudinal directions (oblongly extending directions) of the magnetic regions 33, 37 that protrude to the outside of the placement space 52*a* substantially coincide with the conveying direction of each package blank BL.

On the both lateral sides in the conveying direction of the conveyor 51, the magnetizing rollers 55, 59 are disposed at such positions as to be able to come into contact with the protruding magnetic regions 33, 37. More specifically, a vertical wall 57 provided on the left side in the conveying direction of the conveyor 51, on which the magnetic region 33 protrudes, is mounted with a support shaft 58 so as to horizontally extend in the direction perpendicular to the conveying direction, and the magnetizing roller 59 is rotatably mounted on the support shaft 58. Furthermore, a vertical wall 53 provided on the right side in the conveying direction of the conveyor 51, on which the magnetic region 37 protrudes, is mounted with a support shaft 54 so as to horizontally extend in the direction perpendicular to the conveying direction, and the magnetizing roller 55 is rotatably mounted on the support shaft 54. The vertical walls 53, 57 are fixed to a base portion of the supply line 22*a*, and therefore stays at a constant position regardless of the conveyance of the conveyor 51. Therefore, the magnetizing roller 59, 55 are disposed above the magnetic regions 33, 37 of the package blank BL laterally conveyed by the conveyor 51, respectively.

A counter roller 56 is disposed so as to face the magnetizing roller 55 below the magnetizing roller 55, and a counter roller 60 is disposed so as to face the magnetizing roller 59 below the magnetizing roller 59. The counter rollers 56, 60 are rotatably supported by the support shafts (not illustrated) similarly to the magnetizing rollers 55, 59. The package blank BL is laterally conveyed in an interval between the magnetizing roller 55 and the counter roller 56, and an interval between the magnetizing roller 59 and the counter roller 60, so that while the magnetic region 37 and the magnetic region 33 on the package blank BL come into contact with the magnetizing rollers 55, 59, respectively, the package blank BL is conveyed to the downstream side of the magnetizing rollers 55, 59.

Herein, a specific constitution of the magnetizing roller 55 will be described with reference to FIG. 5. Magnet disks 55*a* formed of neodymium magnets, and iron disks 55*b* formed of iron which is a magnetic substance are alternately inserted into the support shaft 54, so that the magnetizing roller 55 is formed. At this time, the adjacent magnet disks 55*a* between which each iron disk 55*b* is sandwiched is mounted such that magnet poles in end surfaces in the axis direction of the support shaft 54 are reverse to each other. The thickness of each magnet disk 55*a* is, for example, 1 mm, and the thickness of each iron disk 55*b* is 0.5 mm. Additionally, the diameter of each iron disk 55*b* is slightly larger than the diameter of each magnet disk 55*a*. In the magnetizing roller 55 thus formed, a magnetic distribution where N poles and S poles are alternately arrayed is formed on a surface of the magnetizing roller 55 (roller surface coming into contact with the magnetic material 45), and a magnetic distribution having relatively strong magnetic force is formed by correlation between the size of the magnet disks 55*a* and the size of the iron disks 55*b*, namely, correlation in the diameter and the thickness.

The counter roller 56 facing the magnetizing roller 55 is a resin roller which is a nonmagnetic substance as described above. Therefore, the magnetic distribution formed on the surface of the magnetizing roller 55 is never disturbed due to existence of the counter roller 56. When the package blank BL is sent into the interval between the magnetizing roller 55 and the counter roller 56 by lateral conveyance, the magnetic region 37 efficiently comes into contact with the above surface of the magnetizing roller 55 due to the existence with the counter roller 56, and therefore the magnetic region 37 is magnetized in accordance with the magnetic distribution on the surface of the magnetizing roller 55. More specifically, in the light of a state where the longitudinal direction of the magnetic region 37 and the conveying direction of the package blank BL substantially coincide with each other, a belt-shaped magnetic distribution of the N poles and the S poles is formed along the longitudinal direction of the magnetic region 37.

Figure 5:
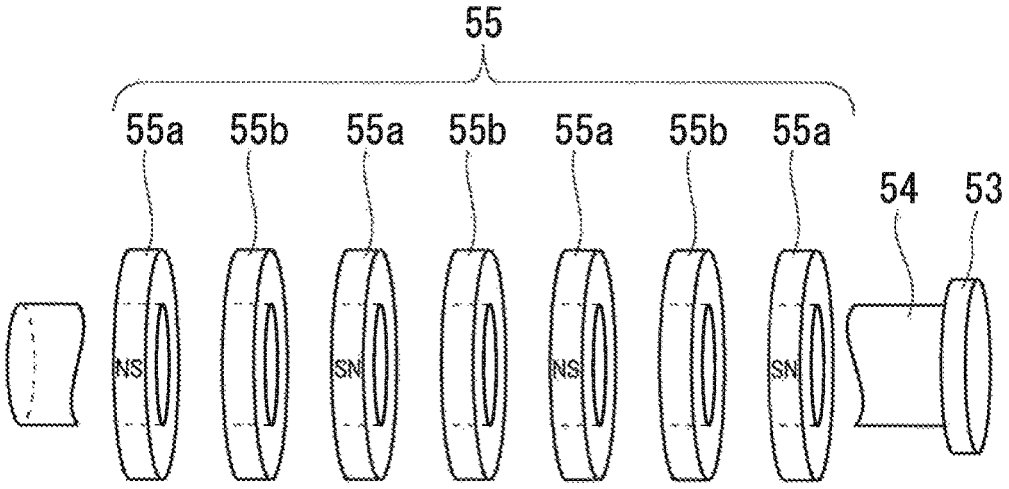
FIG. 5 is a diagram illustrating a schematic configuration of a magnetizing roller included in the magnetizing configuration illustrated in FIG. 4.

Similarly to the magnetizing roller 55, as illustrated in FIG. 5, magnet disks having the same shapes as the magnet disks 55*a*, and iron disks having the same shapes as the iron disks 55*b* are alternately inserted into the support shaft 58, so that the magnetizing roller 59 is formed. That is, also in the magnetizing roller 59, correlation between the size of the magnet disks and the size of the iron disks are equal to the correlation between the size of the magnet disks 55*a* and the size of the iron disks 55*b* in the magnetizing roller 55. Consequently, also in the magnetic region 33, a belt-shaped magnetic distribution of N poles and S poles is satisfactorily formed along the longitudinal direction of the magnetic region 33. In a state where the magnetic region 37 and the magnetic region 33 face each other, which is formed by closing the tongue-lid part 32, placement of the magnet disks and the iron disks in the magnetizing rollers 55, 59 is adjusted such that the belt-shaped magnetic distribution on the magnetic region 37, and the belt-shaped magnetic distribution on the magnetic region 33 correspond to each other, namely, for example, belt-shaped regions magnetized into the S poles on the magnetic region 33 face belt-shaped regions magnetized into the N poles on the magnetic region 37, and belt-shaped regions magnetized into the N poles on the magnetic region 33 face belt-shaped regions magnetized into the S poles on the magnetic region 37.

As described above, in the packaging machine illustrated in FIG. 3, in the process of each lateral conveyance of the package blank BL, the magnetic regions 33, 37 are magnetized by the magnetizing rollers 55, 59 formed as described above. In this magnetizing process, the contact state of each magnetic region and each magnetizing roller is kept, and therefore a desired magnetic distribution can be reliably formed in each of the magnetic regions. Furthermore, in the magnetization by the magnetizing rollers 55, 59, each package blank BL is laterally conveyed by the conveying machine 50, and therefore the magnetizing timing of the magnetic region 33 and the magnetizing timing of the magnetic region 37 are substantially the same, and the magnetizing periods are partially overlapped, magnetization of the magnetic regions can be performed as quickly as possible.

<Modification of Magnetization Processing in Lateral Conveyance Process>

Figure 6A:
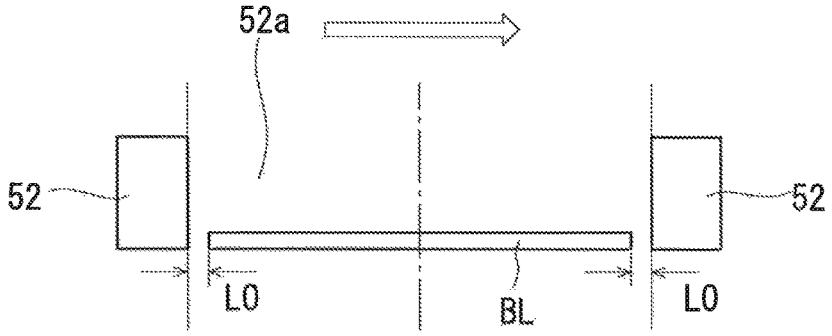
FIG. 6A is a diagram illustrating a placement state of the package blank in a case where the package blank is laterally conveyed by a conveying machine, in the packaging machine of the present invention.

Herein, in the supply line 22*a* where the lateral conveyance is performed, as described above, the interval between the adjacent pushers 52 is set to be larger than the width in the lateral direction of each package blank BL such that the package blank BL is smoothly disposed from the hopper 24 in the placement space 52*a* on the conveyor 51. For example, as illustrated in FIG. 6A, when the package blank BL is disposed in the placement space 52*a*, a predetermined clearance L0 exists between the package blank BL and each pusher 52. Thus, the clearance between each pusher 52 and the package blank BL is useful for smooth placement. On the other hand, the clearance is a surplus space where the package blank BL can move in the placement space 52*a*.

Herein, as illustrated in FIG. 2, as described above, no specific blank portion is disposed on the lateral sides of the blank portion corresponding to the tongue 38 where the magnetic region 37 is formed. On the other hand, blank portions corresponding to the side walls 31*b* are disposed on the both lateral sides of the blank portion corresponding to the front wall 31*a* where the magnetic region 33 is formed. Accordingly, in a case where magnetization of the magnetic region 37 and magnetization of the magnetic region 33 are performed by the magnetizing roller 55 and the magnetizing roller 59, respectively, the magnetizing roller 59 comes into contact with the package blank BL solely, namely, without cooperation with the magnetizing roller 55. In this sole contact of the magnetizing roller 59, the package blank BL is sandwiched between the magnetizing roller 59 and the counter roller 60 corresponding to the magnetizing roller 59, and therefore frictional force acts only on one side (left side in the conveying direction) of the package blank BL. As a result, rotational deviation of the package blank BL in the placement space 52*a* is generated, and there is a fear that formation of a desired magnetic distribution in each of the magnetic regions 33, 37 becomes difficult. The frictional force is referred to as "rotational deviation frictional force".

Figure 6B:
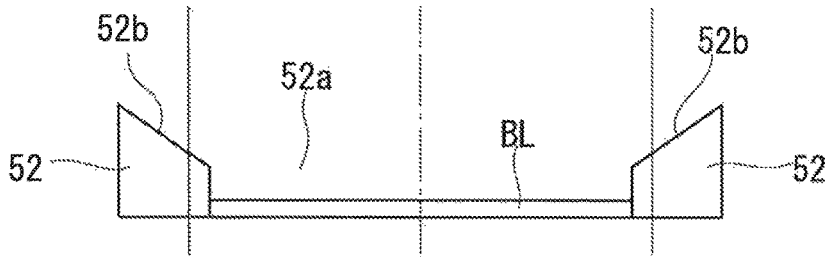
FIG. 6B is a diagram illustrating a placement state of the package blank in a case where the package blank is laterally conveyed by a conveying machine, in the packaging machine of the present invention.
Figure 6C:
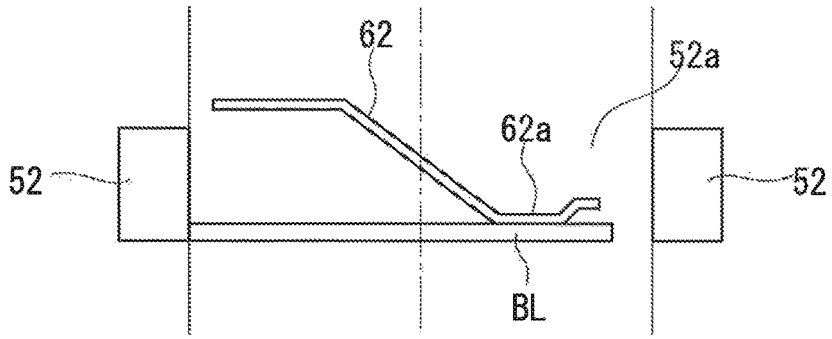
FIG. 6C is a diagram illustrating a placement state of the package blank in a case where the package blank is laterally conveyed by a conveying machine, in the packaging machine of the present invention.
Figure 6D:
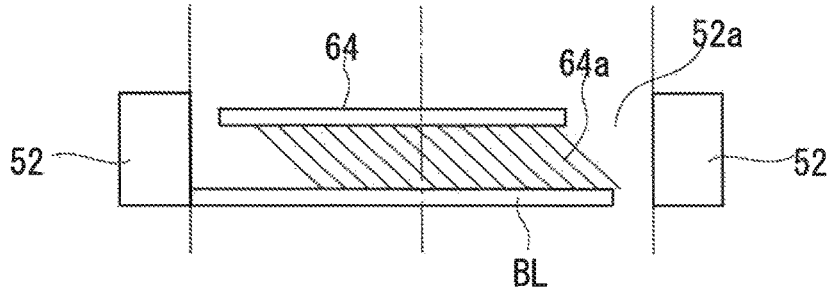
FIG. 6D is a diagram illustrating a placement state of the package blank in a case where the package blank is laterally conveyed by a conveying machine, in the packaging machine of the present invention.

A method for suppressing of such the rotational deviation of the package blank BL in the placement space 52*a* will be described with reference to FIGS. 6B to 6D. FIGS. 6B to 6D each are a sectional view taken along the conveying direction of the package blank BL disposed in the placement space 52*a*, similarly to FIG. 6A. First, as illustrated in FIG. 6B, an interval between the pushers 52 forming each placement space 52*a* is made to be the same as the width in the lateral direction of the package blank BL as much as possible. Consequently, even if rotational deviation frictional force acts on the package blank BL, the rotational deviation is reliably regulated by the pushers 52, and therefore it is possible to avoid inhibition of the desired magnetic distribution formation. On the other hand, the interval between the pushers 52 become narrow, so that placement of the package blank BL in placement space 52*a* can become difficult. Therefore, chamfers 52*b* are formed on upper edges of the pushers 52 on the sides close to the placement space 52*a*. The chamfers 52*b* are thus formed, so that each package blank BL thrown from the hopper 24 is guided by slant faces of the chamfers 52*b* to be easily housed in the placement space 52*a*. A chamfer angle or size of each chamfer 52*b* may be suitably provided in consideration of ease of housing of the package blank BL in the placement space 52*a*.

As another method for suppressing rotational deviation of the package blank BL in the placement space 52*a*, as illustrated in FIG. 6C or FIG. 6D, in a case where an interval between the pushers 52 is the same as the interval between the pushers 52 illustrated in FIG. 6A, a pressing device 62, 64 that presses the package blank BL disposed in the placement space 52*a* toward the conveying surface may be provided in each placement space 52*a*. The pressing device 62 illustrated in FIG. 6C is a spring plate which is bent such that urging force acts on the package blank BL from a plate leading end 62*a*. The pressing device 64 illustrated in FIG. 6D is a brush which causes urging force to act on the package blank BL by contact with brush bristles 64*d*. These pressing devices 62, 64 operate so as to be brought into the states illustrated in FIGS. 6C and 6D after the package blank BL is disposed in the placement space 52*a* from the hopper 24.

<Magnetization Processing in Longitudinal Conveyance Process>

Now, magnetization processing in the supply line 22*b* will be described with reference to FIGS. 7A, 7B, 8A, 8B. As described above, in the supply line 22*b*, longitudinal conveyance of the package blank BL is performed in the longitudinal direction illustrated by the void arrow illustrated in FIG. 7A and FIG. 8A by the conveying machine 50. Accordingly, in the longitudinal conveyance, the magnetic region 37 and the magnetic region 33 are lined in the conveying direction.

Figure 7A:
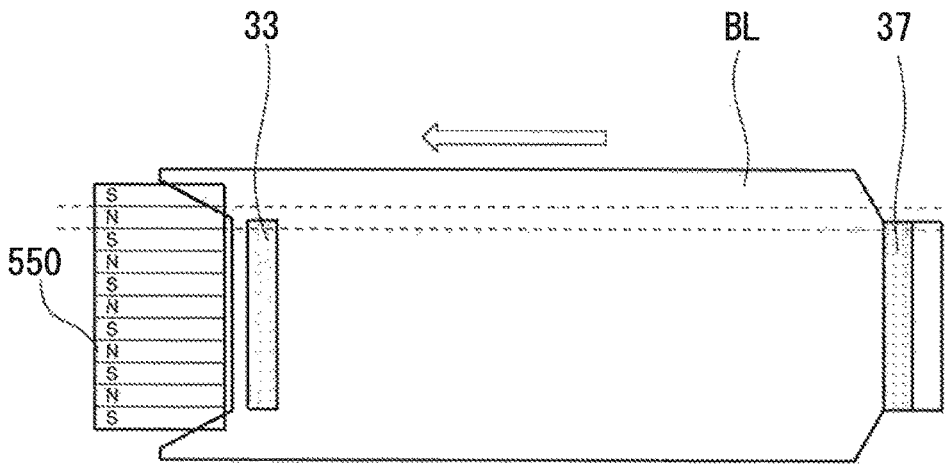
FIG. 7A is a diagram for illustrating a state where the magnetic regions are magnetized in an overlapped state in a case where the package blank is longitudinally conveyed by the conveying machine.
Figure 7B:
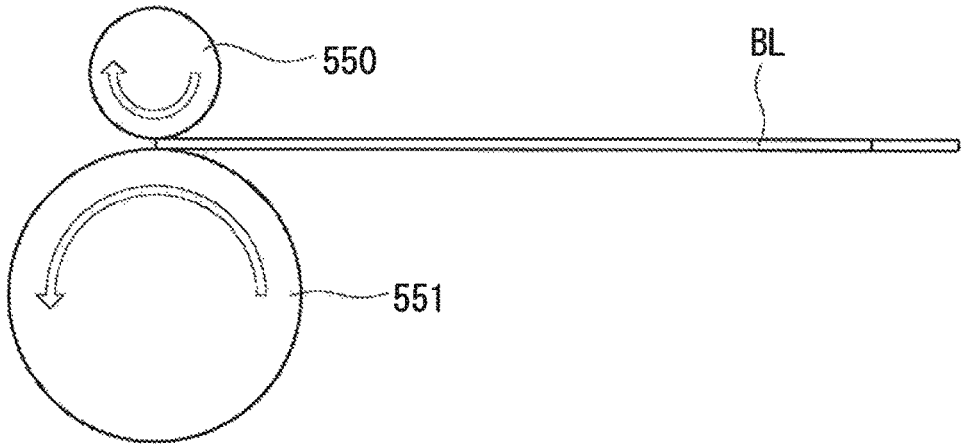
FIG. 7B is a diagram for illustrating a state where the magnetic regions are magnetized in an overlapped state in a case where the package blank is longitudinally conveyed by the conveying machine.

Herein, before the magnetization processing in the packaging machine of the present invention is described, problems of the magnetization processing in the longitudinal conveyance process will be described with reference to FIGS. 7A and 7B. In FIGS. 7A and 7B, a state where the magnetization processing is performed for the package blank BL being longitudinally conveyed by a magnetizing roller 550 and a counter roller 551 is schematically illustrated. A top view of the state of the magnetization processing is illustrated in FIG. 7A, and a side view of the state of the magnetization processing is illustrated in FIG. 7B. The magnetizing roller 550 has a configuration similar to the configuration of the magnetizing roller 55 illustrated in FIG. 5. In a form of the magnetization processing illustrated in FIGS. 7A and 7B, the magnetizing roller 550 and the counter roller 551 are mounted on the conveying machine such that the axial direction of the magnetizing roller 550 is orthogonal to the conveying direction. The package blank BL is conveyed in the longitudinal direction with respect to the magnetizing roller 550 and the counter roller 551 that are thus installed, the magnetic region 33 and the magnetic region 37 are sequentially magnetized by the magnetizing roller 550.

As illustrated in FIGS. 7A and 7B, in a longitudinal conveyance step, when the magnetization processing is performed, in the magnetic regions 33, 37, regions of N poles and S poles are formed in belt-shapes along the width directions (direction orthogonal to the longitudinal direction). However, both the magnetic regions are magnetized by the single magnetizing roller 550, and therefore in the state where the magnetic region 37 and the magnetic region 33 face each other, which is formed by closing the tongue-lid part 32, magnetic fields formed in a portion of the magnetic region 37 and a portion of the magnetic region 33 that face each other are the same magnet pole (for example, N poles). As a result, in a state where the magnetic region 37 and the magnetic region 33 deviate from each other such that portions on which magnetic attraction acts face each other, the magnetic region 37 and the magnetic region 33 finally come into contact with each other by the magnetic attraction, the deviated state is maintained. In formation of such a magnetic distribution, the tongue-lid part 32 is closed in a state of slightly deviating from or slightly inclining with respect to the package body 31, and therefore this formation is not preferable.

Figure 8A:
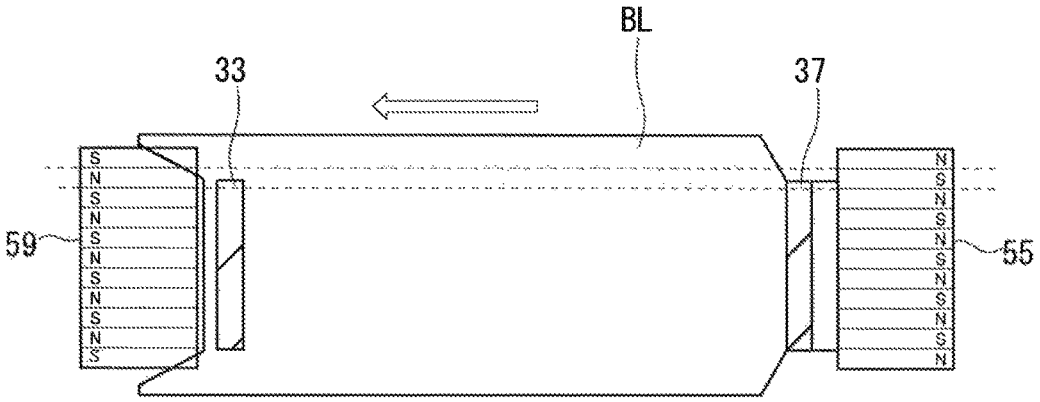
FIG. 8A is a diagram for illustrating a state where the magnetic regions are magnetized, in a case where the package blank is longitudinally conveyed by the conveying machine, in the packaging machine of the present invention.
Figure 8B:
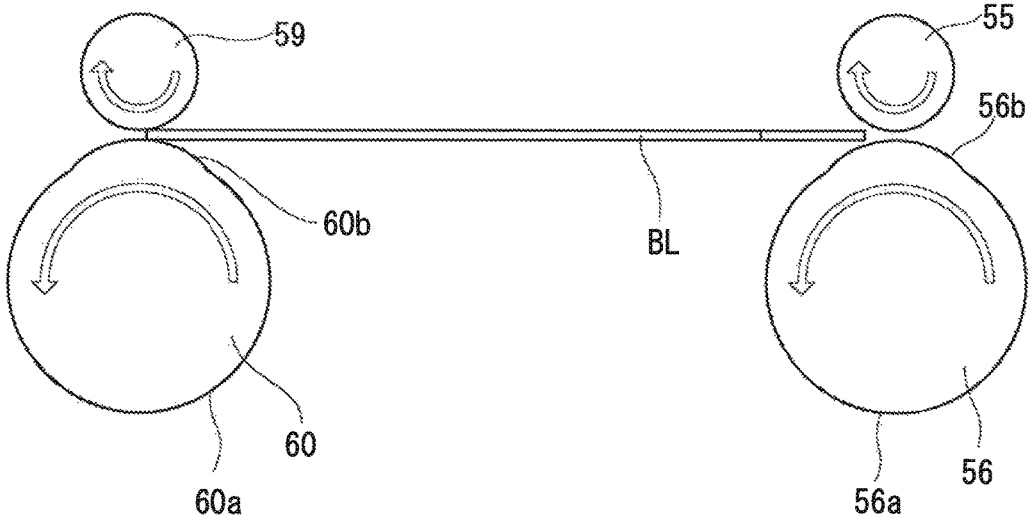
FIG. 8B is a diagram for illustrating a state where the magnetic regions are magnetized, in a case where the package blank is longitudinally conveyed by the conveying machine, in the packaging machine of the present invention.

FIGS. 8A and 8B illustrate a placement configuration of the magnetizing rollers for magnetization processing in the longitudinal conveyance step adopted in the packaging machine of the present invention, in the light of this point. A top view of the placement configuration is illustrated in FIG. 8A, and a side view of this configuration is illustrated in FIG. 8B. In the configuration illustrated in FIG. 8, the magnetizing roller 59 and the counter roller 60 corresponding to the magnetic region 33, and the magnetizing roller 55 and the counter roller 56 corresponding to the magnetic region 37 are disposed along the conveying direction. In the state where the magnetic region 37 and the magnetic region 33 face each other, which is formed by closing the tongue-lid part 32, a magnetic distribution formed on each of surfaces of the magnetizing roller 55 and the magnetizing roller 59 is adjusted such that magnetic fields formed in a portion of the magnetic region 37 and a portion of the magnetic region 33 that face each other are different magnet poles (for example, an N pole is formed in a portion of the magnetic region 33, and an S pole is formed in a portion of the magnetic region 37, as illustrated in FIG. 8A). The adjustment of the magnetic distribution is performed by adjustment of placement of magnet disks and iron disks included in each magnetizing roller.

However, in a case where the longitudinal conveyance is performed, when the magnetizing roller 59 and the magnetizing roller 55 are lined along the conveying direction as illustrated in FIGS. 8A and 8B, the one magnetic region is magnetized in an overlapped manner by the two magnetizing rollers. As a result, there is a fear that it becomes difficult to form a desired magnetic distribution in the magnetic region. Therefore, a protrusion 60*b* is provided on a peripheral surface of the counter roller 60, and a protrusion 56*b* is provided on a peripheral surface of the counter roller 56.

This protrusion 60*b* is provided on the peripheral surface of the counter roller 60 such that the magnetic region 33 can come into contact with the magnetizing roller 59 by contact of a package portion provided with the magnetic region 33 with the protrusion 60*b*, and a package portion provided with no magnetic region 33 (including a package portion provided with the magnetic region 37) comes into non-contact with the magnetizing roller 59 by contact of the package portion with a peripheral portion 60*a* provided with no protrusion 60*b*, when the package blank BL is fed between the magnetizing roller 59 and the counter roller 60. Additionally, the protrusion 56*b* is provided on the peripheral surface of the counter roller 56 such that the magnetic region 37 can come into contact with the magnetizing roller 55 by contact of the package portion provided with the magnetic region 37 with the protrusion 56*b*, and the package portion provided with no magnetic region 37 (including the package portion provided with the magnetic region 33) comes into non-contact with the magnetizing roller 55 by contact of the package portion provided with a peripheral portion 56*a* provided with no protrusion 56*b*, when the package blank BL is fed between the magnetizing roller 55 and the counter roller 56.

With such configurations of the magnetizing rollers 55, 59, and the counter rollers 56, 60, a desired magnetic distribution can be reliably formed in each magnetic region as quickly as possible even in the longitudinal conveyance process.

<Other Magnetization Processing>

The above magnetization processing is performed in the lateral conveyance process in the supply line 22*a* and the longitudinal conveyance process in the supply line 22*b*. Also in a place other than these places, the magnetization processing for the magnetic regions 33, 37 may be performed by use of the magnetizing rollers 55, 59. For example, the above magnetization processing can be performed on the fifth wheel 20 where the package blank BL in contact with the inner wrapping body IB is folded. On the fifth wheel 20, the package blank BL is rotationally moved on a periphery of the wheel, but the movement is substantially the same as the lateral conveyance. Accordingly, the magnetization processing on the fifth wheel 20 can be applied to the magnetization processing which is substantially the same as the magnetization processing in the above lateral conveyance process.

<Modification of Package>

Figure 9:
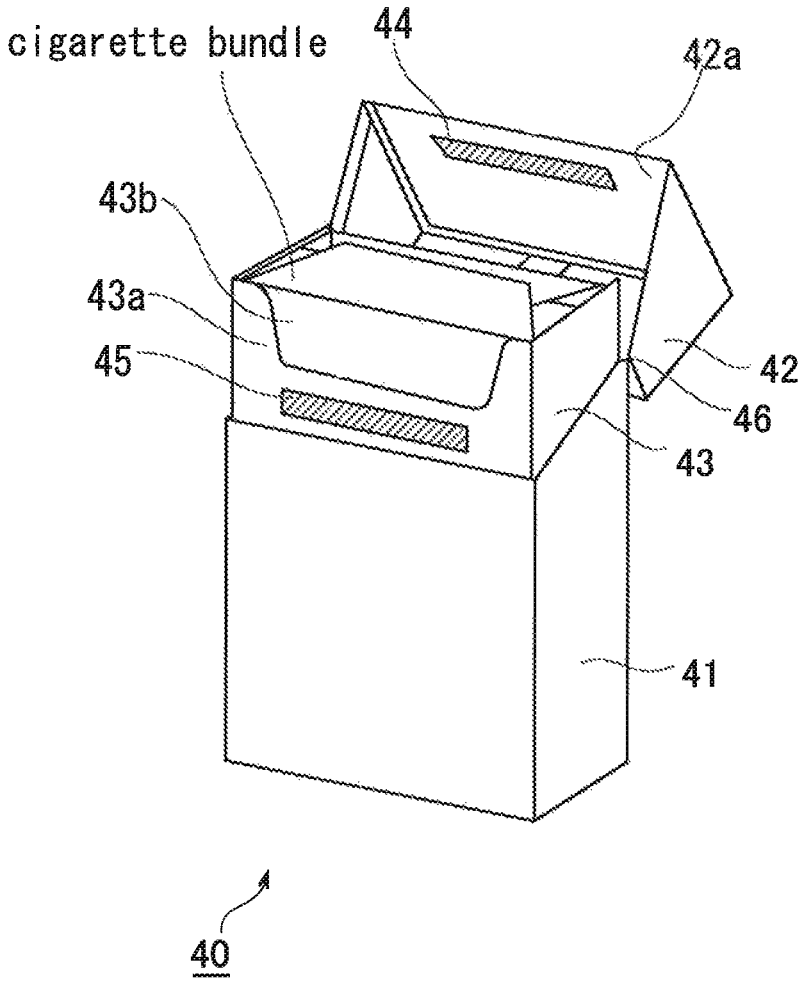
FIG. 9 is a diagram schematically illustrating a hinge-lid package manufactured by the packaging machine of the present invention.

In the above embodiment, the manufacturing process of the tongue-lid package, particularly, the magnetizing process of the magnetic regions 33, 37 is described. However, in place of this package, also in a manufacturing process of a so-called hinge-lid package, a technical idea related to the packaging machine of the present invention can be applied. FIG. 9 discloses a so-called hinge-lid package (hereinafter referred to simply as a "package") 40 for housing a cigarette bundle. In the package 40, a lid part 42 is hinged to a package body 41 through a hinge part 46, so that an opening of a housing space (space where a cigarette bundle is housed) can be opened and closed in the package body 41. The package 40 is provided with magnetic regions 44, 45 as a locking mechanism of the lid part 42 to the package body 41. The magnetic regions 44, 45 each are formed by being coated with a magnetic material containing a ferrite-based magnetic material. Additionally, in the completion state of the package 40 illustrated in FIG. 9, the magnetic regions 44, 45 are magnetized, and the lid part 42 and the package body 41 are locked by magnetic attraction that acts between the both regions. For magnetic regions 44, 45, neodymium-based magnetic materials may be utilized.

More specifically, the magnetic region 45 is formed below a cutout 43*b* of an inner frame front surface 43*a* of an inner frame 43 included in the package body 41, as an oblong region extending to the sides of the package. On the other hand, the magnetic region 44 is famed on an inner flap 42*a* overlapped with an inner surface of a front panel of the lid part 42, as an oblong region extending to the sides of the package, similarly to the magnetic region 45. The relative relation between the position of the magnetic region 45 in the inner frame front surface 43*a*, and the position of the magnetic region 44 in the inner flap 42*a* is determined such that the above positions face each other in a state where the lid part 41 closes the opening of the housing space.

In the package 40 thus formed, when the lid part 42 is closed from the state illustrated in FIG. 9 by a user, and the magnetic region 44 comes close to the magnetic region 45 to some extent, the lid part 42 connected by a flange is attracted toward the package body 41 (inner frame 43) by magnetic attraction that acts between both the magnetic regions, and the magnetic region 44 comes into contact with the magnetic region 45, so that contact sound which indicates the contact is generated. Then, the contact state is maintained by the magnetic attraction between both the magnetic regions. Accordingly, the magnetic attraction is requested to be larger than restoring force for attempting to separate the lid part 42 from the package body 41 by the hinge connection of the hinge part 46.

When the lid part 42 is opened by the contact of the both the magnetic regions from the state where the lid part 42 closes the opening of the housing space, the user needs to make force larger than the magnetic attraction between both the magnetic regions to act on the lid part 42, and to rotate the lid part 42. Accordingly, as long as force smaller than the magnetic attraction acts on the lid part that is in a closed state, the closed state is maintained, and therefore it can be said that the magnetic attraction is resistance force for preventing the lid part 42 from opening accidentally. Accordingly, the magnetic attraction is requested to be force that is larger than necessary resistance force, and is smaller than predetermined force such that force for intentionally opening the lid part 42 by a user does not become excessive unnecessarily.

Figure 10:
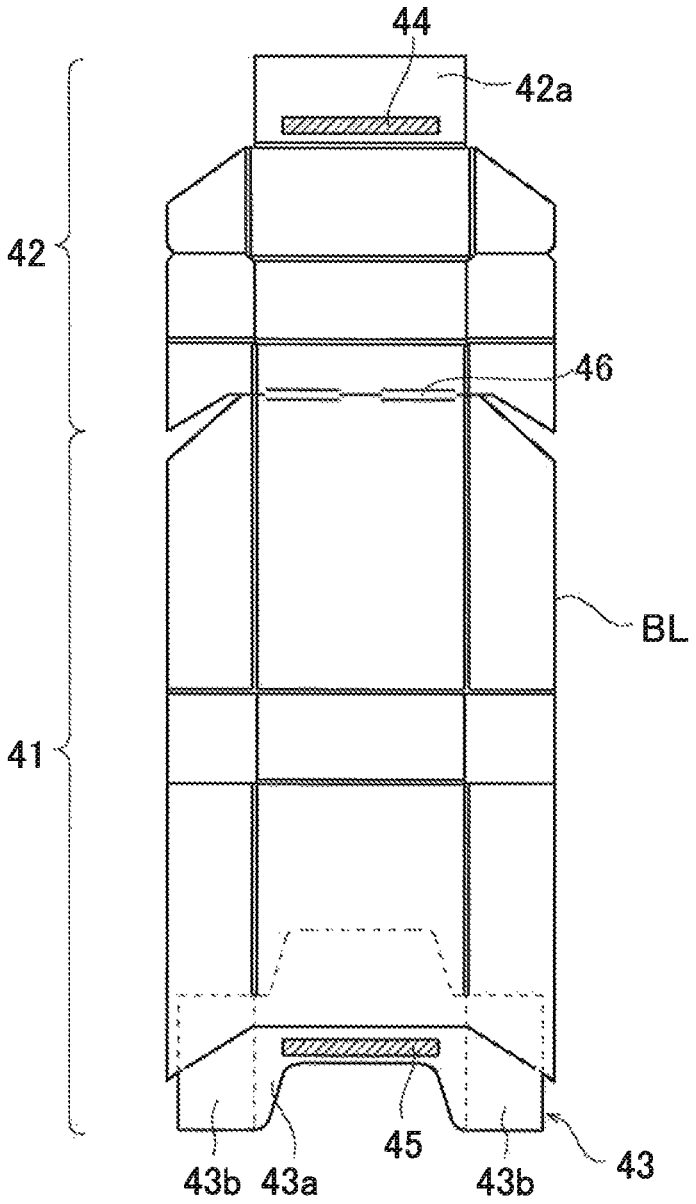
FIG. 10 is a diagram illustrating a package blank obtained by unfolding the hinge-lid package illustrated in FIG. 9.

FIG. 10 illustrates a package blank BL obtained by unfolding the package 40 illustrated in FIG. 9. The package blank BL is composed of a blank portion corresponding to the package body 41 including the inner frame 43, and a blank portion corresponding to the lid part 42. The blank portions each are a component forming a part of the package blank BL. Furthermore, the magnetic region 44 formed on the lid part 42 is disposed on the blank portion corresponding to the inner flap 42*a*, and the magnetic region 45 formed on the package body 41 is disposed on the blank portion corresponding to the inner frame front surface 43*a*. The former blank portion is equivalent to a first blank portion of the present invention, and the latter blank portion is equivalent to a second blank portion of the present invention.

In the package 40 thus formed, while the magnetic region 44 is disposed on the lid part 42, the magnetic region 45 is disposed on the inner frame 43. The lid part 42 is connected to the package body 41, and is a separated member from the inner frame 43. In magnetization of the magnetic regions 44, 45 in the package 40, in a case where the inner frame 43 is bonded to the package body 41 to form the package blank BL as illustrated in FIG. 10, the magnetic regions 44, 45 can be magnetized by the magnetizing rollers 55, 59 at substantially the same timing as described above with reference to FIG. 4. Additionally, before the inner frame 43 is bonded to the package body 41 to form the package blank BL, the magnetic region 45 on the inner frame 43 and the magnetic region 44 on the lid part 42 may be magnetized by the corresponding magnetizing rollers at different timing in the respective conveyance processes. In this case, after both the regions are magnetized, the both are bonded to each other.

<Reference Example>

Figure 11:
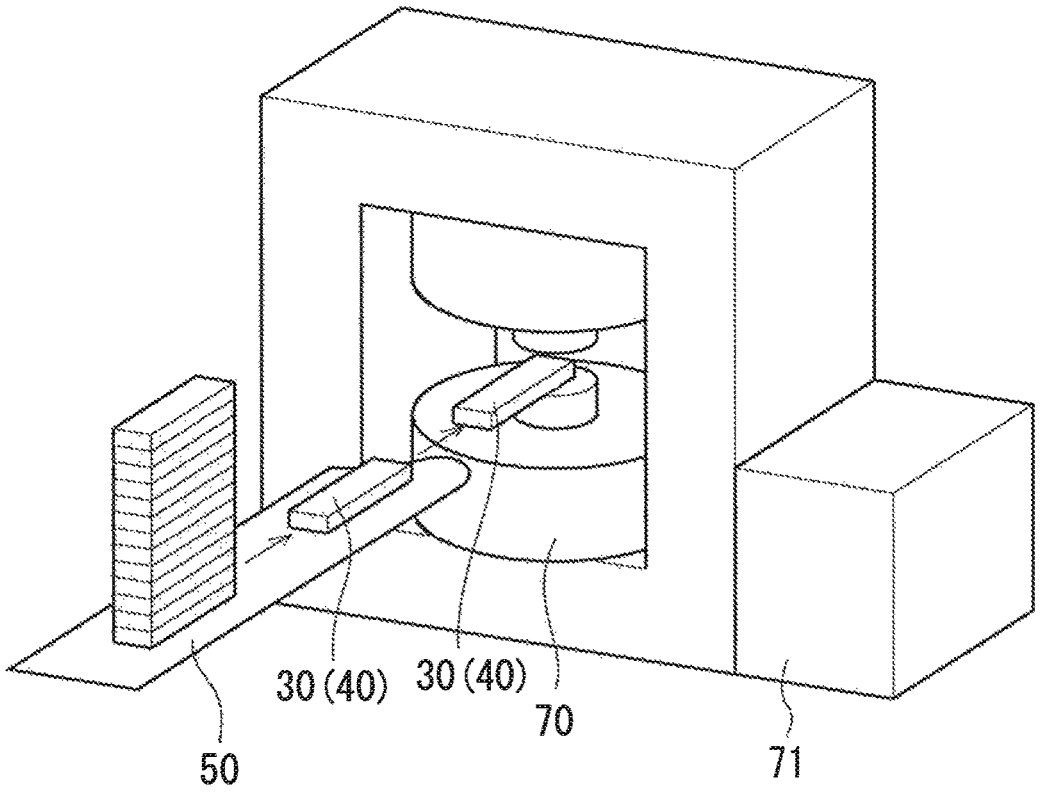
FIG. 11 is a diagram illustrating another embodiment (reference example) for magnetizing the lid package.

FIG. 11 illustrates a reference example of magnetization processing of the magnetic regions 33, 37 (44, 45). In the reference example, each package 30 (40) that is a complete body as a package, namely that is fed out from a feed line 32 is sequentially conveyed to a magnetizing machine 70 by a conveying machine 50, and the magnetization processing is performed in the state of the package complete body. The magnetizing machine 70 is a machine that receives power supply from a power supply unit 71, and generates a powerful magnetic field between two electrodes. Then, each package 30 (40) conveyed by the conveying machine 50 is sent into a space between the electrodes to be stopped. The magnetic field is generated in this state, so that the unmagnetized magnetic regions 33, 37 (44, 45) included in the package 30 (40) are magnetized. As long as suitable magnetization is performed, a plurality of unmagnetized packages may be placed between the electrodes.

REFERENCE SIGNS LIST

22 blank supply system
22*a*, 22*b* supply line
30, 40 package
31, 41 package body
32 tongue-lid part
42 lid part
33, 37, 44, 45 magnetic region
50 conveying machine
51 conveyor
52 pusher
52*a* placement space
52*b* chamfer
55, 59 magnetizing roller
55*a* magnet disk
55*b* iron disk
56, 60 counter roller
56*b*, 60*b* protrusion

The invention claimed is:

1. A packaging machine for a package, the package having a package body having a housing space for housing an object to be housed, and a lid part formed so as to cover an opening of the housing space of the package body, wherein the lid part is provided with a lid-side magnetic region that is coated with an unmagnetized magnetic material, and the package body is provided with a body-side magnetic region that is coated with an unmagnetized magnetic material, at such a predetermined position on the package body as to face the lid-side magnetic region in a complete state of the package where the lid part covers the opening of the housing space, the packaging machine comprising:

a conveying machine that conveys a package blank for the package, while in the package blank, at least a first blank portion related to the lid-side magnetic region, and a second blank portion related to the body-side magnetic region are in a predetermined unfolded state;

a lid-side magnetizing roller that is supported so as to be able to come into contact with the lid-side magnetic region of the package blank being conveyed in the predetermined unfolded state by the conveying machine, and so as to be rotatable when coming into contact, and has a permanent magnet which magnetizes the magnetic material of the lid-side magnetic region; and a body-side magnetizing roller that is supported so as to be able to come into contact with the body-side magnetic region of the package blank being conveyed in the predetermined unfolded state by the conveying machine, and so as to be rotatable when coming into contact, and has a permanent magnet for magnetizing the magnetic material of the body-side magnetic region so as to form a predetermined magnetic distribution corresponding to a magnetic distribution in the lid-side magnetic region formed by the lid-side magnetizing roller.

2. The packaging machine for a package according to claim 1, wherein contact with the lid-side magnetic region by the lid-side magnetizing roller, and contact with the body-side magnetic region by the body-side magnetizing roller are performed in at least a partially overlapped period.

3. The packaging machine for a package according to claim 1, wherein contact with the lid-side magnetic region by the lid-side magnetizing roller, and contact with the body-side magnetic region by the body-side magnetizing roller are performed in different periods which are not overlapped.

4. The packaging machine for a package according to claim 1, wherein the lid-side magnetizing roller is formed by alternately supporting a plurality of lid-side magnet disks each formed of the permanent magnet, and a plurality of lid-side magnetic substance disks each formed of a magnetic substance on a support shaft rotatably, the body-side magnetizing roller is formed by alternately supporting a plurality of body-side magnet disks each having the same width as each of the lid-side magnet disks and each formed of the permanent magnet, and a plurality of body-side magnetic substance disks each having the same width as each of the lid-side magnetic substance disks and each formed of a magnetic substance on a support shaft rotatably, and a belt-shaped magnetic distribution is formed in the lid-side magnetic region by the lid-side magnetizing roller, and the predetermined magnetic distribution is foiled in a belt shape in the body-side magnetic region by the body-side magnetizing roller.

5. The packaging machine for a package according to claim 4, wherein a diameter of each of the lid-side magnetic substance disks is not less than a diameter of each of the lid-side magnet disks, and a diameter of each of the body-side magnetic substance disks is not less than a diameter of each of the body-side magnet disks.

6. The packaging machine for a package according to claim 1, further comprising:

a lid-side counter roller that is formed of a nonmagnetic substance, is located on a side opposite to the lid-side magnetizing roller with the package blank sandwiched between the lid-side counter roller and the lid-side magnetizing roller when the lid-side magnetizing roller comes into contact with the package blank, and is similarly supported so as to be able to come into contact with the package blank, and so as to be rotatable when coming into contact; and a body-side counter roller that is formed of a nonmagnetic substance, is located on a side opposite to the body-side magnetizing roller with the package blank sandwiched between the body-side counter roller and the body-side magnetizing roller when the body-side magnetizing roller comes into contact with the package blank, and is similarly supported so as to be able to come into contact with the package blank, and so as to be rotatable when coming into contact.

7. The packaging machine for a package according to claim 6, wherein the lid-side counter roller and the body-side counter roller each are formed of a resin material.

8. The packaging machine for a package according to claim 6, wherein the predetermined unfolded state is a state where the first blank portion and the second blank portion are located on opposite sides in a direction perpendicular to a conveying direction of the package blank with a central portion of the package blank therebetween, the conveying machine has a regulating member of a predetermined height, the regulating member being a member which forms a placement space for disposing the package blank in the predetermined unfolded state and regulates movement of the package blank at front and rear in the conveying direction of the package blank, and the regulating member is disposed so as to come into contact with the package blank from the front and the rear in the conveying direction, and a chamfer is formed on an upper edge of the regulating member on a side close to the placement space.

9. The packaging machine for a package according to claim 6, wherein the predetermined unfolded state is a state where the first blank portion and the second blank portion are located on opposite sides in a direction perpendicular to a conveying direction of the package blank with a central portion of the package blank therebetween, the conveying machine has a regulating member of a predetermined height, the regulating member being a member which forms a placement space for disposing the package blank in the predetermined unfolded state and regulates movement of the package blank at front and rear in the conveying direction of the package blank, and a pressing device that presses the package blank disposed in the placement space against a conveying surface from above.

10. The packaging machine for a package according to claim 6, wherein the predetermined unfolded state is a state where the first blank portion and the second blank portion are located along a conveying direction of the package blank, the lid-side counter roller and the body-side counter roller are disposed such that one of the lid-side counter roller and the body-side counter roller is located on an upstream side with respect to the other counter roller along a conveying direction of the package, the lid-side counter roller has, on a roller periphery, a first protrusion enabling the first blank portion to be sandwiched between the lid-side magnetizing roller and the first protrusion in a period in which the lid-side magnetizing roller is in contact with the lid-side magnetic region, and the lid-side counter roller is formed such that the lid-side magnetizing roller is in non-contact with the package blank in a case where the lid-side counter roller is in contact with the package blank at a portion on the periphery other than the first protrusion, the body-side counter roller has, on a roller periphery, a second protrusion enabling the second blank portion to be sandwiched between the body-side magnetizing roller and the second protrusion in a period in which the body-side magnetizing roller is in contact with the body-side magnetic region, and the body-side counter roller is formed such that the body-side magnetizing roller is in non-contact with the package blank in a case where the body-side counter roller is in contact with the package blank at a portion on the periphery other than the second protrusion, the first protrusion and the second protrusion are disposed in the lid-side counter roller and the body-side counter roller respectively such that the lid-side magnetic region comes into contact with the lid-side magnetizing roller, and does not come into contact with the body-side magnetizing roller, and the first protrusion and the second protrusion are further disposed in the lid-side counter roller and the body-side counter roller respectively such that the body-side magnetic region comes into contact with the body-side magnetizing roller, and does not come into contact with the lid-side magnetizing roller.

11. A packaging method for a package, the package having a package body having a housing space for housing an object to be housed, and a lid part formed so as to cover an opening of the housing space of the package body, wherein the lid part is provided with a lid-side magnetic region that is coated with an unmagnetized magnetic material, the package body is provided with a body-side magnetic region that is coated with an unmagnetized magnetic material, at such a predetermined position on the package body as to face the lid-side magnetic region in a complete state of the package where the lid part covers the opening of the housing space, the packaging method comprising:

a conveying step of conveying a package blank for the package, while in the package blank, at least a first blank portion related to the lid-side magnetic region, and a second blank portion related to the body-side magnetic region are in a predetermined unfolded state, a lid-side magnetizing step of bringing a lid-side magnetizing roller having a permanent magnet and rotatably supported into contact with the lid-side magnetic region of the package blank being conveyed in the predetermined unfolded state, and magnetizing the magnetic material of the lid-side magnetic region; and a body-side magnetizing step of bringing a body-side magnetizing roller having a permanent magnet and rotatably supported into contact with the body-side magnetic region of the package blank being conveyed in the predetermined unfolded state, and magnetizing the magnetic material of the body-side magnetic region so as to form a predetermined magnetic distribution corresponding to a magnetic distribution in the lid-side magnetic region formed by the lid-side magnetizing roller.

12. The packaging method for a package according to claim 11, wherein contact with the lid-side magnetic region by the lid-side magnetizing roller in the lid-side magnetizing step, and contact with the body-side magnetic region by the body-side magnetizing roller in the body-side magnetizing step are performed in at least a partially overlapped period.

13. The packaging machine for a package according to claim 11, wherein contact with the lid-side magnetic region by the lid-side magnetizing roller in the lid-side magnetizing step, and contact with the body-side magnetic region by the body-side magnetizing roller in the body-side magnetizing step are performed in different periods which are not overlapped.

14. The packaging machine for a package according to claim 11, wherein in the conveying step, the package blank is conveyed such that the first blank portion and the second blank portion are located along a conveying direction of the package blank, and the magnetization of the magnetic material of the lid-side magnetic region in the lid-side magnetizing step, and the magnetization of the magnetic material of the body-side magnetic region in the body-side magnetizing step are sequentially performed in accordance with conveyance of the package blank such that in a state where the lid-side magnetic region and the body-side magnetic region face each other at a time of formation of the package, magnetic fields formed in one portion of the lid-side magnetic region and one portion of the body-side magnetic region that face each other are different from each other.

* * * * *